US007654175B2

(12) United States Patent
Hamon

(10) Patent No.: US 7,654,175 B2
(45) Date of Patent: Feb. 2, 2010

(54) SLIDE-DRIVER

(76) Inventor: Rodney D. Hamon, 624 Lisa, Burleson, TX (US) 76028

( * ) Notice: Subject to any disclaimer, the term of this patent is extended or adjusted under 35 U.S.C. 154(b) by 43 days.

(21) Appl. No.: 12/066,820

(22) PCT Filed: Sep. 19, 2006

(86) PCT No.: PCT/US2006/036450

§ 371 (c)(1),
(2), (4) Date: Mar. 13, 2008

(87) PCT Pub. No.: WO2007/038082

PCT Pub. Date: Apr. 5, 2007

(65) Prior Publication Data

US 2008/0223182 A1 Sep. 18, 2008

(51) Int. Cl.
*B25B 13/02* (2006.01)
*B25B 13/06* (2006.01)

(52) U.S. Cl. ..... 81/125; 81/124.5

(58) Field of Classification Search ..... 81/125, 81/124.4, 124.5, 185, DIG. 11, 124.2, 121.1
See application file for complete search history.

(56) References Cited

U.S. PATENT DOCUMENTS

| | | | | | |
|---|---|---|---|---|---|
| 1,471,451 | A | * | 10/1923 | Crimp | 81/185 |
| 1,626,730 | A | * | 5/1927 | Haynes | 81/185 |
| 4,840,094 | A | * | 6/1989 | Macor | 81/185 |
| 5,163,344 | A | * | 11/1992 | Mathers | 81/124.5 |
| D338,380 | S | * | 8/1993 | Hermanson | D8/29 |

* cited by examiner

*Primary Examiner*—Hadi Shakeri
(74) *Attorney, Agent, or Firm*—James E. Walton

(57) ABSTRACT

A tool for rotating fasteners has an inner body with a cavity in a forward end, the cavity being configured to engage the head of a fastener. An outer socket has a cavity in a forward end, the cavity being configured to engage the head of a fastener, and the outer socket is coaxial with and slidably carried on the inner body. The outer socket is movable between retracted and extended positions, the retracted position locating the cavity of the inner body in a position for engagement of the head of a fastener, the extended position locating the cavity of the outer socket in a position for engagement of the head of a fastener.

8 Claims, 8 Drawing Sheets

SLIDE-DRIVER

TECHNICAL FIELD

The present invention relates generally to tools for driving fasteners and specifically to a tool providing multiple drivers for driving fasteners.

DESCRIPTION OF THE PRIOR ART

Hex-head fasteners are a common type of fastener, and these fasteners may be in the form of, for example, threaded screws, threaded bolts, or threaded nuts. To apply the necessary torque for tightening or loosening hex-head fasteners, a tool having opposing parallel sides, such as a wrench, or a hexagonal cavity, such as a socket or nut driver, is positioned so that the tool engages the hex head of the fastener. The tool may then be rotated in a selected direction, which rotates the fastener.

Hex-head fasteners come in many different sizes, and many types of tools exist for installing and removing these fasteners. Tools include wrenches, sockets, and nut drivers, and these tools are typically sold in sets containing many sizes of tools for accommodating the various sizes of fasteners. This means that one tool is provided for each fastener size. An alternative to providing one tool for each size fastener is an adjustable wrench, which is adjustable within a selected range. Another alternative is to have multiple size heads on each end of a wrench.

Although great strides have been made in the art of tools for fasteners, significant shortcomings remain.

SUMMARY OF THE INVENTION

There is a need for a tool providing multiple drivers for driving fasteners.

Therefore, it is an object of the present invention to provide a tool providing multiple drivers for driving fasteners.

A tool for rotating fasteners has an inner body with a cavity in a forward end, the cavity being configured to engage the head of a fastener. An outer socket has a cavity in a forward end, the cavity being configured to engage the head of a fastener, and the outer socket is coaxial with and slidably carried on the inner body. The outer socket is movable between retracted and extended positions, the retracted position locating the cavity of the inner body in a position for engagement of the head of a fastener, the extended position locating the cavity of the outer socket in a position for engagement of the head of a fastener.

The present invention provides for several advantages, including: (1) providing access in one tool to different sized drivers for driving fasteners; (2) negating the need for the user to carry multiple drivers; and (3) providing a magnet assembly for retaining fasteners within the tool in both the retracted and extended positions.

BRIEF DESCRIPTION OF THE DRAWINGS

For a more complete understanding of the present invention, including its features and advantages, reference is now made to the detailed description of the invention taken in conjunction with the accompanying drawings, in which.

DESCRIPTION OF THE PREFERRED EMBODIMENT

The present invention is directed to a tool having at least inner and outer sockets for use in installing and removing fasteners having heads of different sizes. The outer socket is larger that the inner socket and is movable between a retracted position, in which the inner socket is used, and an extended position, in which the outer socket is used. The preferred embodiment is configured for use with hex-head fasteners, though the tool of the invention may be configured for use with fasteners of other types, such as square-head fasteners. A magnet assembly within the tool retains fasteners within the tool during use of either socket.

The tool of the present invention provides access in one tool to different sized magnetized drivers for driving fasteners and is simpler in construction, more universally usable, and more versatile in operation than known apparatus of this kind.

Figure 1:
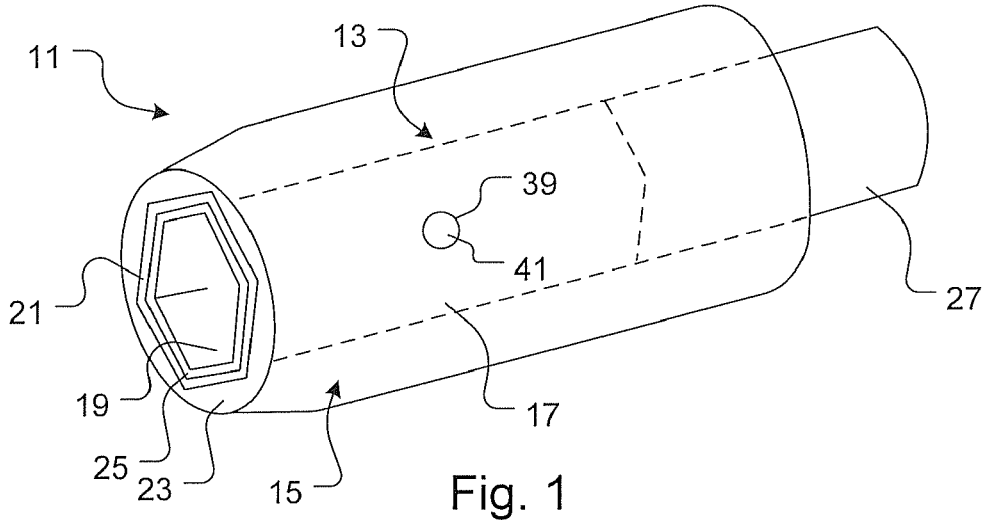
FIG. 1 is an oblique view of a preferred embodiment of a slide-driver according to the present invention, the slide-driver being shown in a retracted position.
Figure 2:
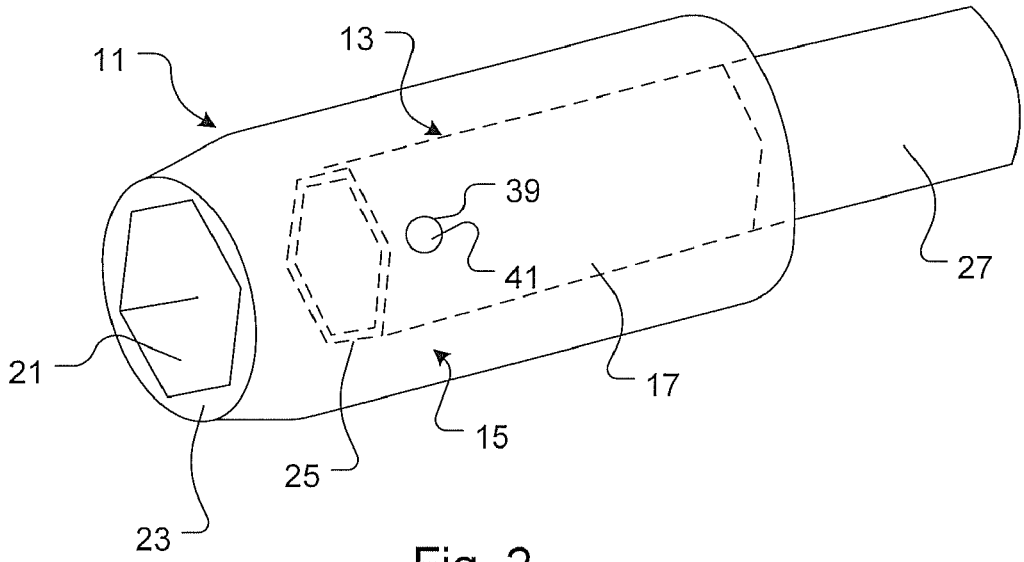
FIG. 2 is an oblique view of the slide-driver of FIG. 1, the slide-driver being shown in an extended position.

FIGS. 1 and 2 illustrate a slide-driver 11 according to a preferred embodiment of the present invention. Slide-driver 11 comprises an inner body 13 and an outer socket 15. Inner body 15 has a socket portion 17 having a hexagonal cavity 19 and located at a forward end of body 15, and socket 15 has a hexagonal cavity 21 that is larger than socket portion 17 of inner body 13. Outer socket 15 is coaxially and slidably carried on inner body 15, which fits within cavity 21 of socket 15. Outer socket 15 is moveable between a retracted position, which is shown in FIG. 1, and an extended position, which is shown in FIG. 2. In the retracted position, a forward face 23 of inner body 13 is generally coplanar with a forward face 25 of socket 15, and this allows cavity 19 of socket portion 17 to engage the head of a fastener having a first size. In the extended position, socket 15 is moved forward relative to body 13, such that forward faces 23, 25 are spaced from each other, and this allows hexagonal cavity 21 to engage the head of a fastener having a second, larger size.

Figure 3:
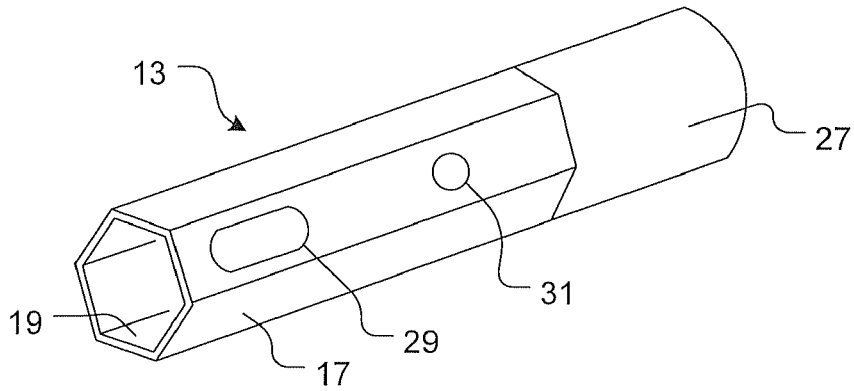
FIG. 3 is an oblique view of an inner body of the slide-driver of FIG. 1.
Figure 4:
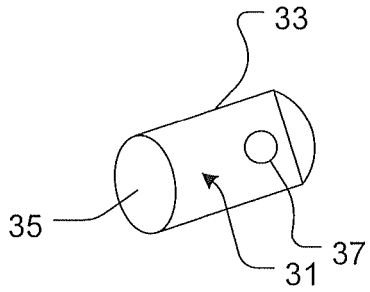
FIG. 4 is an oblique view of a magnet assembly of the slide-driver of FIG. 1.
Figure 5:
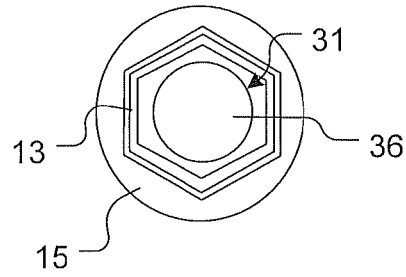
FIG. 5 is a front view of the slide-driver of FIG. 1.

FIG. 3 shows inner body 13 removed from within socket 15. Body 13 is generally tubular, with an attachment portion 27 extending rearward from socket portion 17. Attachment portion 27 may be configured for attachment to other components, as shown in alternative embodiments described below, for use in rotating slide driver 11. Elongated slots 29 are formed in opposing sidewalls of body 13, and a detent aperture 30 is also formed in a sidewall rearward of one of slots 29. A magnet assembly 31, which is shown in FIG. 4, comprises a housing 33 and a magnet 35 carried within housing 33. Housing 33 has a hole 37 formed therethrough. Housing 33 is sized to be slidably carried within body 13, as shown in FIG. 5.

Figure 6:
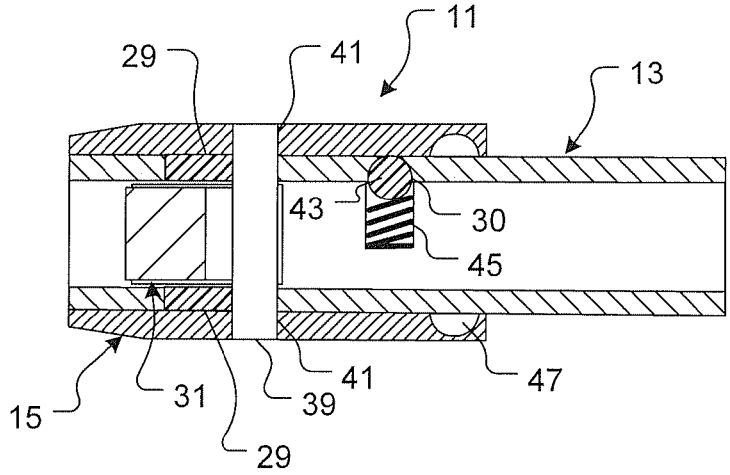
FIG. 6 is a side cross-section view of the slide-driver of FIG. 1, the slide-driver being shown in a retracted position.
Figure 7:
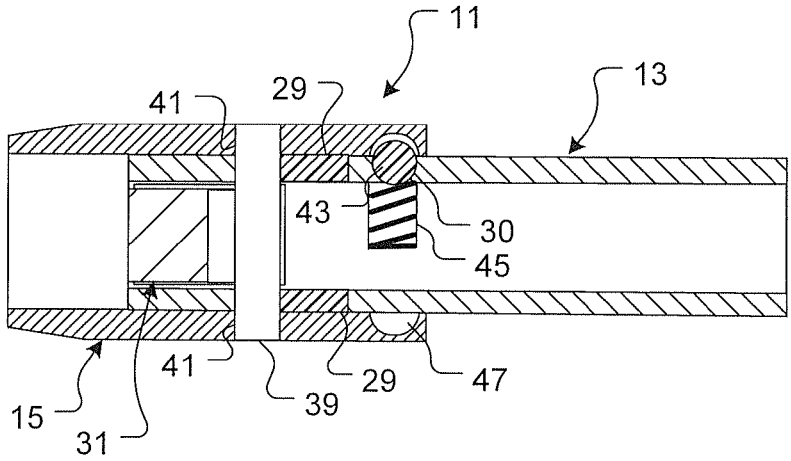
FIG. 7 is a side cross-section view of the slide-driver of FIG. 1, the slide-driver being shown in an extended position.

FIGS. 6 and 7 are side, cross-section views of slide-driver 11 in the retracted and extended positions, respectively. Body 13 is located within socket 15, and magnet assembly 31 is located within body 13. A pin 39 extends through slots 29, through hole 37 in housing 33 of magnet assembly 31, and through holes 41, which are formed in opposing sidewalls of socket 15. This configuration allows socket 15 and magnet assembly 31 to move together relative to body 13, and the length of slots 29 defines the allowed travel. Magnet assembly 31 remains near a fastener head engaged by either cavity 19 or cavity 21 for retaining the fastener within cavity 19 or cavity 21.

To retain socket 15 in the extended position, a detent assembly is provided. A detent ball 43 is located in detent aperture 30 of body 13 and is biased radially outward by spring 45. When socket 15 is moved into the extended position, detent ball 43 engages an annular groove 47 formed on an inner surface of socket 15, as shown in FIG. 7. The force of spring 45 is selected to provide a sufficient detent capability for use, but the force is not so great as to prevent a user from overcoming the force to move socket 15 to the retracted position.

Figure 8:
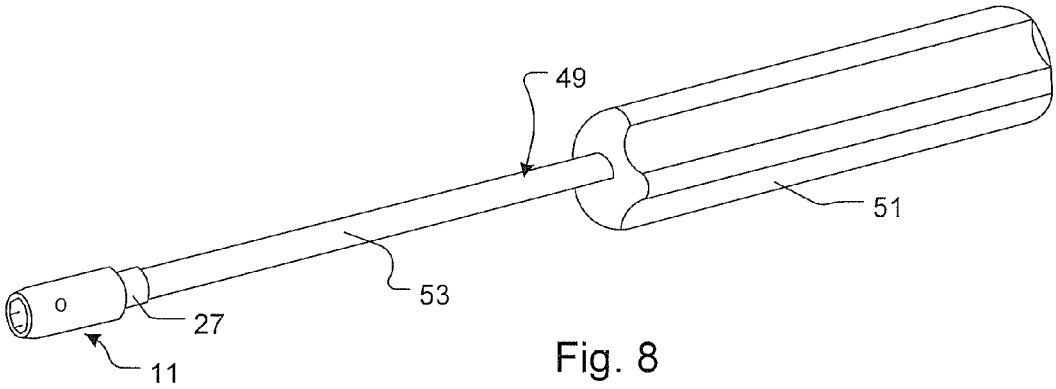
FIG. 8 is an oblique view of an alternative embodiment of a slide-driver according to the invention.

FIG. 8 illustrates an alternative embodiment according to the invention, in which slide-driver 11 is attached to a handle 49. Handle 49 comprises a grip 51 and a shaft 53, and slide-driver 11 is affixed to shaft 53 with attachment portion 27. Handle 49 provides for manual rotation of slide-driver 11 by hand by a user.

Figure 9:
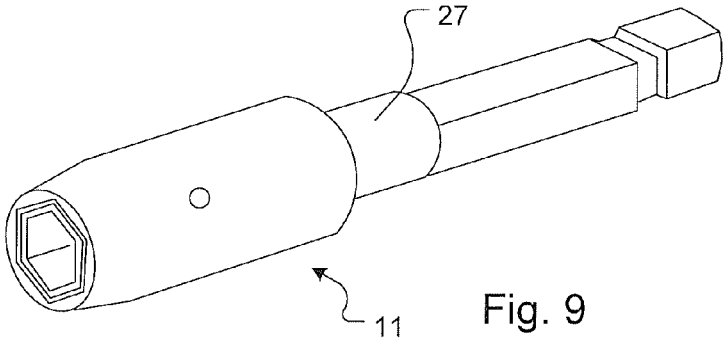
FIG. 9 is an oblique view of another alternative embodiment of a slide-driver according to the invention.

FIG. 9 illustrates an alternative embodiment according to the invention, in which slide-driver 11 is configured for use with a powered means of rotation. Slide driver 11 is shown attached to a stem 55 with attachment portion 27, stem 55 having a hexagonal cross-section and configured for insertion in, for example, a rotating portion of an electric drill.

Figure 10:
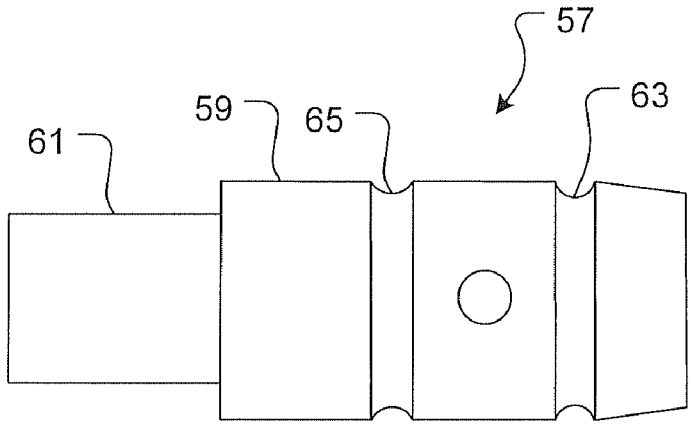
FIG. 10 is a side view of a another alternative embodiment of a slide-driver according to the invention, the slide-driver being shown in a retracted position.
Figure 11:
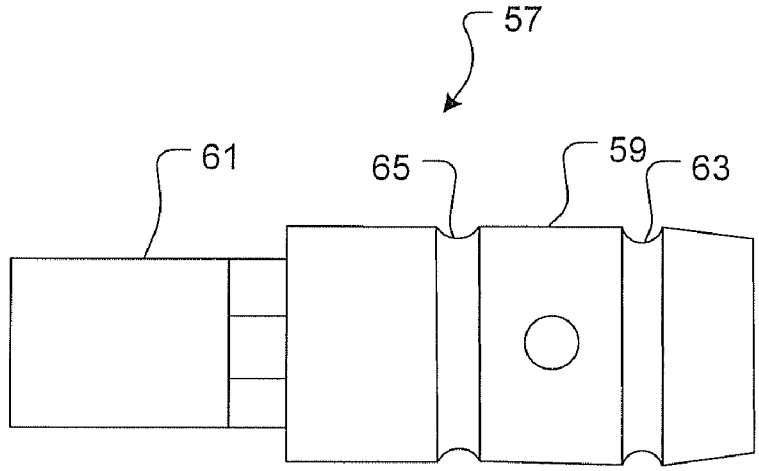
FIG. 11 is a top view of the slide-driver of FIG. 10, the slide-driver being shown in a retracted position.

FIGS. 10 and 11 show an alternative embodiment according to the invention, in which a slide-driver 57 comprises an outer socket 59 and an inner body 61. Slide-driver 57 is constructed and operates similarly to slide-driver 11, which is described above. In this embodiment, circumferential grooves 63, 65 are formed in the exterior sidewall of socket 59 to form a grip profile. This improves the ability of a user to grip the exterior of socket 59 for moving socket between a retracted position, shown in FIG. 10, and an extended position, shown in FIG. 11.

FIGS. 12 through 19 illustrate additional alternative embodiments of the slide-drive of the invention, in which the slide-drivers have a variety of means for retaining an outer socket in a selected position.

Figure 12:
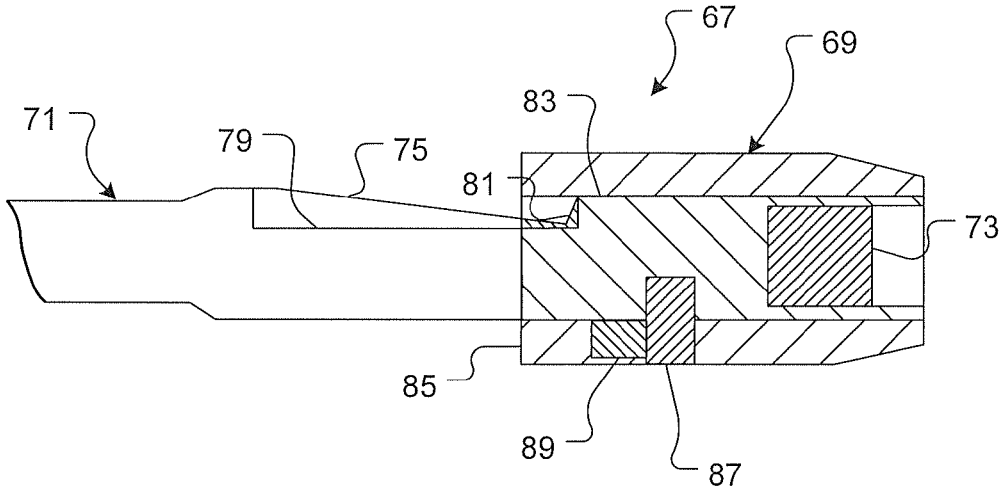
FIG. 12 is a side view of a another alternative embodiment of a slide-driver according to the invention, the slide-driver being shown in a retracted position.
Figure 13:
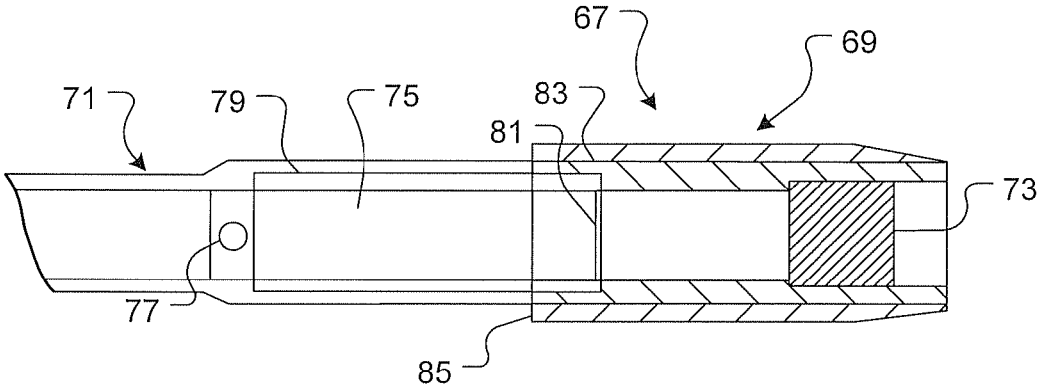
FIG. 13 is a top view of the slide-driver of FIG. 12, the slide-driver being shown in a retracted position.
Figure 14:
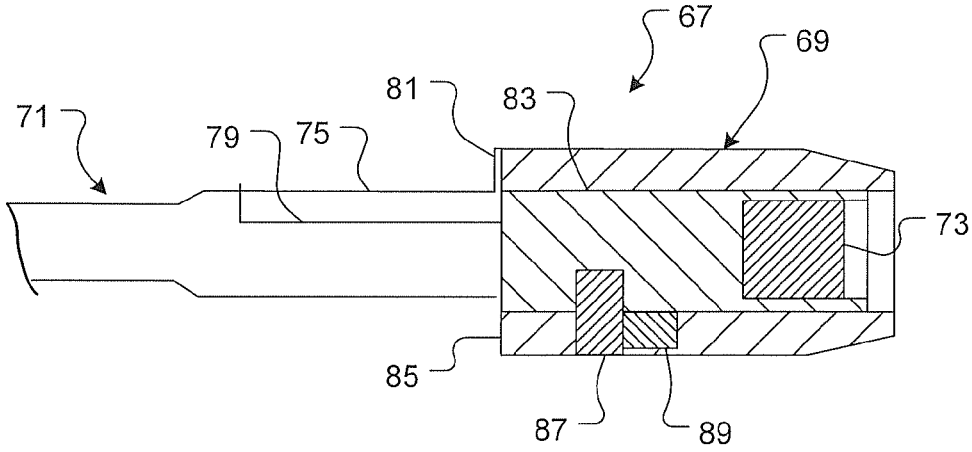
FIG. 14 is a side view of the slide-driver of FIG. 12, the slide driver being shown in an extended position.
Figure 15:
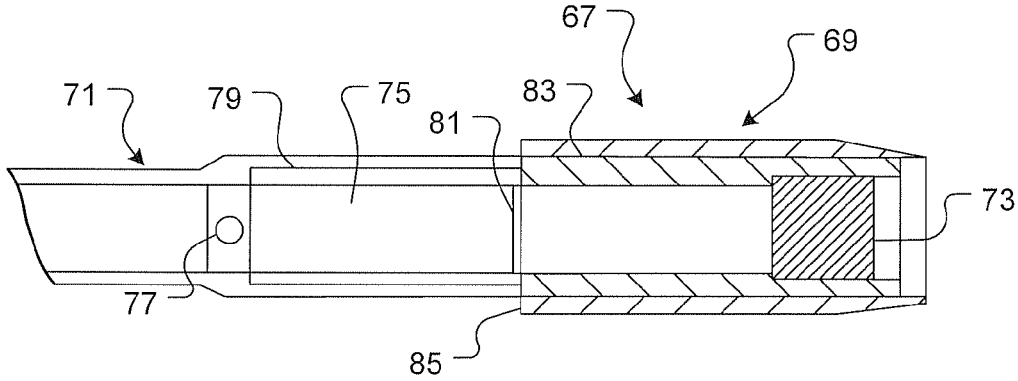
FIG. 15 is a top view of the slide-driver of FIG. 12, the slide driver being shown in an extended position.

FIGS. 12 through 15 show an alternative embodiment according to the invention, in which a slide-driver 67 has an outer socket 69 and an inner body 71. A magnet 73 is affixed in a forward portion of inner body 71. A flat spring 75 is affixed to inner body 71 with a pin 77 and is located above a rectangular groove 79 formed in inner body 71. Spring 75 has a lip 81 formed on a forward end of spring 75, lip 81 being generally perpendicular to the remainder of spring 75. Groove 79 is sized to allow spring 75 to be bent into groove 79, so that when socket 69 is in a retracted position, as shown in FIG. 12, lip 81 is located within socket 69. In this position, an outer edge of lip 81 contacts inner surface 83 of socket 69. As shown in FIGS. 14 and 15, when socket 69 is moved to an extended position, socket 69 moves forward for enough distance relative to inner body 71 to allow lip 81 to spring outward as rear face 85 of socket 69 passes. This positions lip 81 adjacent rear face 85 and allows lip 81 and spring 75 to prevent socket 69 from returning to the retracted position. To return socket 69 to the retracted position, a user applies force to spring 75 to bend spring 75 into groove 79 until lip 81 clears rear face 85, and then the user can move socket 69 to the retracted position. To limit movement of socket 69 on body 71, a pin 87 engages a slot 89 formed in the sidewall of socket 69.

Figure 16:
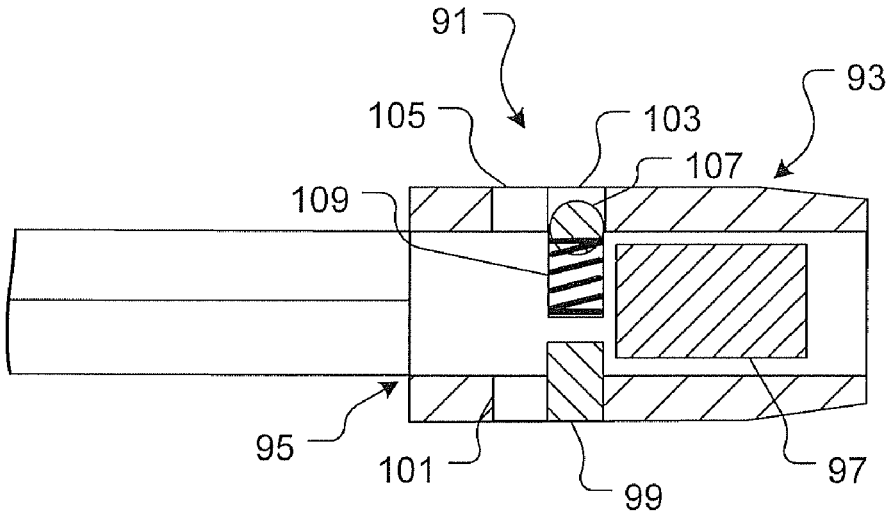
FIG. 16 is a side cross-section view of another alternative embodiment of a slide-driver according to the invention, the slide-driver being shown in a retracted position.
Figure 17:
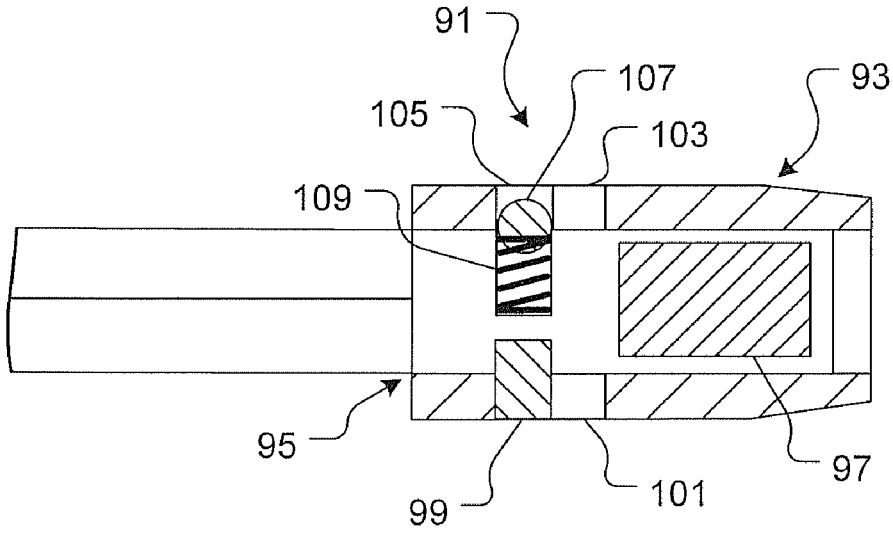
FIG. 17 is a side cross-section view of the slide-driver of FIG. 16, the slide driver being shown in an extended position.

FIGS. 16 and 17 show an alternative embodiment according to the invention, in which a slide-driver 91 has an outer socket 93 and an inner body 95. A magnet 97 is affixed in a forward portion of inner body 95. To limit movement of socket 93 on body 95, a pin 99 engages a slot 101 formed in the sidewall of socket 93. A detent assembly is used to retain outer socket 93 in a retracted position, shown in FIG. 16, or in an extended position, shown in FIG. 17. A forward detent hole 103 and a rearward detent hole 105 are each formed within a sidewall of socket 93, holes 103, 105 being generally adjacent to each other. A detent ball 107 is biased radially outward by a spring 109, causing ball 107 to engage one of holes 103, 105 when socket 93 is moved to an associated position.

Figure 18:
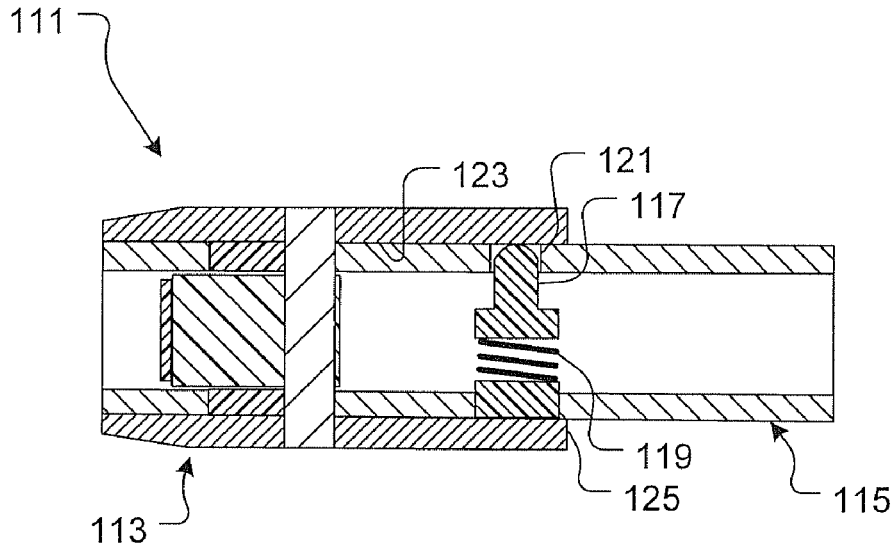
FIG. 18 is a side cross-section view of another alternative embodiment of a slide-driver according to the invention, the slide-driver being shown in a retracted position.
Figure 19:
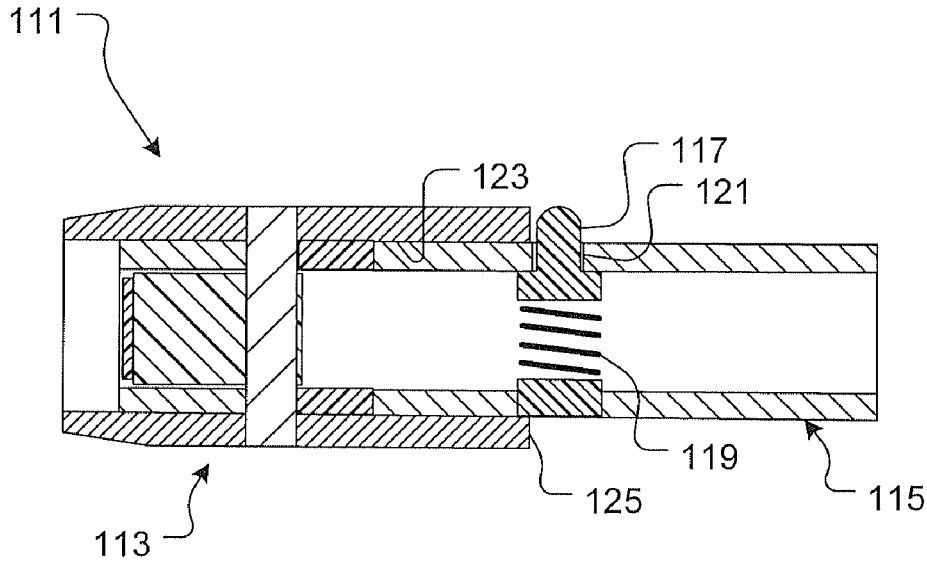
FIG. 19 is a side cross-section view of the slide-driver of FIG. 18, the slide driver being shown in an extended position.

FIGS. 18 and 19 show an alternative embodiment according to the invention, in which a slide-driver 111 has an outer socket 113 and an inner body 115. Slide-driver 111 is constructed similarly to slide-driver 11, described above. A detent assembly is used to retain outer socket 113 in an extended position, shown in FIG. 19. A button detent 117 is installed within inner body 115 and is biased outward by a spring 119. Detent 117 is located so that it extends through a hole 121 formed in a sidewall of inner body 115. When socket 113 is in a retracted position, as shown in FIG. 18, detent 117 is located within socket 113 and contacts inner surface 123 of socket 113. As shown in FIG. 1-9, when socket 113 is moved to an extended position, socket 113 moves forward for enough distance relative to inner body 115 to allow detent 117 to move outward as rear face 125 of socket 113 passes. This positions the outer end of detent 117 adjacent rear face 125 and allows detent 117 to prevent socket 113 from returning to the retracted position. To return socket 113 to the retracted position, a user applies force to detent 117 to compress spring 119 until detent 117 clears rear face 125, and then the user can move socket 113 to the retracted position.

It should be understood that, in addition to the purpose of the slide-driver to provide access in one tool to different sized magnetic drivers for driving hex-head screws, the device can be configured for use with any flat, hexagonal fastener that will fit into any of the various cavities of the slide-driver. Also, while shown as having the outer socket move relative to the inner body, the slide-drivers of the invention may be altered so that the inner body moves relative to the outer socket.

It should also be understood that, although the present invention has been shown and described with respect to a hex-head fastener, the present invention may be configured for use with a wide variety of fastener shapes, including Philips-head fasteners, flat-head fasteners, star-shaped fasteners, and the like. In addition, although the tool of the present invention has been shown with two coaxial hex-head portions, it will be appreciated that drivers for heads of different types may be combined together. For example, a hex driver may be combined with a square driver. In addition, drivers sized in different measurement systems may be combined, such as a driver sized for use with a Metric fastener and a driver sized for use with a SAE fastener.

The present invention provides for several advantages, including: (1) providing access in one tool to different sized drivers for driving hex-head fasteners; (2) negating the need for the user to carry multiple hex drivers; and (3) providing a magnet assembly for retaining fasteners within the tool in both the retracted and extended positions.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

The invention claimed is:

1. A tool for rotating fasteners, comprising:

an inner body having a cavity in a forward end, the cavity being adapted to engage a head of a fastener;

an outer socket having a cavity in a forward end, the cavity being adapted to engage a head of a fastener;

a magnet slidably carried within the inner body and adapted to retain a fastener within the cavities; and a housing slidably carried within the inner body, the magnet being affixed within the housing, the housing being attached to the outer socket for movement with the outer socket between the retracted and extended positions;

wherein the outer socket is coaxial with and slidably carried on the inner body;

wherein the outer socket is movable between retracted and extended positions, the retracted position locating the cavity of the inner body in a position adapted for engagement of the head of a fastener, the extended position locating the cavity of the outer socket in a position adapted for engagement of the head of a fastener; and wherein the magnet is configured for movement with the outer socket between the retracted and extended positions.

2. The tool according to claim 1, wherein:

at least one cavity is adapted to engage a hex-head fastener.

3. The tool according to claim 1, further comprising:

a detent assembly for retaining the outer socket in at least a selected one of the retracted and extended positions.

4. The tool according to claim 1, further comprising:

a groove formed in the inner body; and a flat spring attached to the inner body and positioned adjacent the groove;

wherein the spring retains the outer socket in the extended position; and wherein the spring is bent into the groove to allow the outer socket to move into the retracted position.

5. The tool according to claim 1, further comprising:

a hand grip adapted for allowing a user to manually rotate the tool by hand.

6. The tool according to claim 1, further comprising:

a stem adapted for attachment to a powered rotation device, the stem allowing a user to rotate the tool using the rotation device.

7. The tool according to claim 1, further comprising:

a grip profile formed on an exterior of the outer socket.

8. A multi-size socket head, comprising:

a plurality of socket heads nested together, each socket head being sized to fasten a fastener of like size; and a magnet slidably adapted to retain a fastener within the socket heads; and a housing slidably carried within the socket heads, the magnet being affixed within the housing, the housing being attached to the socket heads for movement with the socket heads between a retracted position and an extended position;

wherein the magnet is configured for movement with an outer socket head of the plurality of socket heads; and wherein the socket heads slide relative to each other, such that the socket heads may be moved into positions to fasten the fasteners of like sizes.

* * * * *